US009752378B2

(12) United States Patent
Gouge et al.

(10) Patent No.: US 9,752,378 B2
(45) **Date of Patent: *Sep. 5, 2017**

(54) STACKABLE MOLDED ARTICLES, AND RELATED ASSEMBLIES AND METHODS

(71) Applicant: Masonite Corporation, Tampa, FL (US)

(72) Inventors: Timothy D. Gouge, Elgin, IL (US); Robert C. Allen, Elburn, IL (US); Allen R. Hill, Laurel, MS (US)

(73) Assignee: Masonite Corporation, Tampa, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/397,119

(22) Filed: Jan. 3, 2017

(65) Prior Publication Data

US 2017/0114589 A1 Apr. 27, 2017

Related U.S. Application Data

(63) Continuation of application No. 14/820,262, filed on Aug. 6, 2015, now Pat. No. 9,534,440.

(60) Provisional application No. 62/034,473, filed on Aug. 7, 2014.

(51) Int. Cl.

| | |
|---|---|
| ***E06B 3/78*** | (2006.01) |
| ***E06B 3/70*** | (2006.01) |
| ***B27N 3/04*** | (2006.01) |
| ***B27N 3/20*** | (2006.01) |
| ***B27N 7/00*** | (2006.01) |

(52) U.S. Cl.

CPC ..... *E06B 3/78* (2013.01); *B27N 3/04* (2013.01); *B27N 3/20* (2013.01); *B27N 7/005* (2013.01); *E06B 3/7001* (2013.01); *E06B 2003/7049* (2013.01)

(58) Field of Classification Search

CPC .. E06B 3/78; E06B 3/7001; E06B 2003/7049; B27N 3/04; B27N 3/20; B27N 7/005

See application file for complete search history.

(56) References Cited

U.S. PATENT DOCUMENTS

| | | | |
|---|---|---|---|
| 5,543,234 | A | 8/1996 | Lynch et al. |
| 5,950,382 | A | 9/1999 | Martino |
| 6,200,687 | B1 | 3/2001 | Smith et al. |
| 6,335,082 | B1 | 1/2002 | Martino |
| 6,588,162 | B2 | 7/2003 | Lynch et al. |
| 6,602,610 | B2 | 8/2003 | Smith |
| 7,021,015 | B2 | 4/2006 | Lynch |

(Continued)

*Primary Examiner* — Beth Stephan

(74) *Attorney, Agent, or Firm* — Berenato & White, LLC

(57) ABSTRACT

Molded articles are provided. An exemplary molded article includes an inner panel portion, a main body portion, and a contoured portion extending between and interconnecting the inner panel portion and the main body portion so as to surround the inner panel portion and be surrounded by the main body portion. The contoured portion includes contoured corner segments and contoured intermediate segments extending between respective pairs of the contoured corner segments. The contoured intermediate segments have a first maximum thickness. The contoured corner segments have a second maximum thickness. The first maximum thickness of the contoured intermediate segments is greater than the second maximum thickness of the contoured corner segments. Related methods, assemblies, and apparatus are also provided.

20 Claims, 10 Drawing Sheets

(56) References Cited

U.S. PATENT DOCUMENTS

| | | | |
|---|---|---|---|
| 7,022,414 | B2 | 4/2006 | Davina |
| 7,137,232 | B2 | 11/2006 | Lynch et al. |
| 7,284,352 | B2 | 10/2007 | Lynch et al. |
| D576,289 | S | 9/2008 | Steiber et al. |
| D616,117 | S | 5/2010 | Steiber et al. |
| 7,823,353 | B2 | 11/2010 | Lynch et al. |
| 7,897,246 | B2 | 3/2011 | Lynch |
| 7,964,051 | B2 | 6/2011 | Lynch et al. |
| 8,069,627 | B2 | 12/2011 | Lynch et al. |
| 8,096,095 | B2 | 1/2012 | Lynch et al. |
| 8,246,339 | B2 | 8/2012 | Luetgert |
| 8,539,729 | B2 | 9/2013 | Lynch et al. |
| 8,545,968 | B2 | 10/2013 | Lynch et al. |
| 8,820,017 | B2 | 9/2014 | Lynch et al. |
| 8,889,247 | B2 | 11/2014 | Lynch |
| 9,534,440 | B2 | 1/2017 | Gouge |
| 2001/0026862 | A1 | 10/2001 | Smith |
| 2001/0029714 | A1 | 10/2001 | Lynch |
| 2008/0274331 | A1 | 11/2008 | Lynch |

STACKABLE MOLDED ARTICLES, AND RELATED ASSEMBLIES AND METHODS

CROSS-REFERENCE TO RELATED APPLICATION AND CLAIM OF PRIORITY

This application is a continuation of U.S. application Ser. No. 14/820,262 filed Aug. 6, 2015, now U.S. Pat. No. 9,534,440, which claims the benefit of priority of U.S. Provisional Application No. 62/034,473 filed Aug. 7, 2014, the complete disclosures of which are incorporated herein by reference.

FIELD OF THE INVENTION

The present invention relates to man-made molded articles, assemblies including one or more of the man-made molded articles, and methods of and apparatus for making the man-made molded articles and assemblies. In certain exemplary embodiments described herein, the man-made molded articles, especially door skins (also known as door facings), have excellent stackability, one article on another, for shipping and storage of the articles without damage.

BACKGROUND OF THE INVENTION

Articles such as doors, wainscot, paneling, cabinet and other furniture doors, and other building materials were traditionally made of natural wood. Natural wood provides an upscale appearance that is aesthetically desirable to many consumers. Unfortunately, due to the depletion of natural resources, natural wood articles have become expensive and much less commonplace than they once were. Also, natural wood has drawbacks, such as its proneness to warping and rotting. As a consequence, many industries, including the building industry, have largely shifted production to focus on man-made materials, such as wood composite materials, fiberglass composites, and thermoplastics.

Man-made molded articles, particularly in the building industry, are often manufactured and/or post-formed to provide an appearance that simulates that of natural wood because of its desirable and upscale appearance. For example, the exterior (observed) surface of a man-made board may be molded or embossed to provide the appearance and feel of a wood grain. U.S. Pat. Nos. 7,367,166, 7,959,817, and 8,246,339, for example, describe molded door skins (also known as door facings) with small grooves configured and arranged to collectively simulate an appearance of a naturally appearing wood grain tick pattern, as well as tonal portions that simulate darkened naturally occurring wood grain background tone. Additionally, the grain patterns on molded articles, especially door skins, may be arranged to simulate the appearance of horizontal and/or vertical extending planks or boards. Planks extending primarily horizontally, that is, widthwise for most entry door skins, such as typically present at the bottom and top of the exterior surface of the door skin and sometimes referred to as rails, may be provided with horizontal wood tick patterns. Planks extending primarily vertically, that is, lengthwise for most entry door skins, such as typically present at the opposite sides of the exterior surface of the door skin and sometimes referred to as stiles, may be provided with vertical wood tick patterns that are generally perpendicular to the horizontal wood tick patterns of the horizontal planks. The exterior surface may also be provided with molded witness lines (or strike lines) to delineate the horizontal and vertical planks from one another. The exterior surface is often coated with paint, stain, lacquer, and/or a protective layer.

The exterior surface of a molded article, especially a door skin, can also be molded to simulate one or more "inner" panels forming part of the exterior surface. In the case of door skins, the inner panels are typically either coplanar with or recessed from the main body portion of the door skin. However, it may be desirable for certain articles to have the inner panels protruding relative to the main surface portion. Contoured portions surround the inner panels to connect the inner panels to the main body portion of the molded article. The contoured portions may be, for example, concave, convex, linear-sloped, and/or stepped walls. The contoured portions may provide superior aesthetic qualities which may, for example, simulate the attractive milled appearance of a natural wood multi-panel door.

Man-made molded articles of the type described above are often stacked on and nested with one another, that is, exterior face to interior face (or vice versa), in nesting relationship for palletized transportation and storage of the articles. Unstable nesting of such stacked molded articles can cause abrasive rubbing of the molded articles against one another, particularly during transport. More specifically, the abrasive rubbing takes place between the finished exterior surface of one molded article and the unfinished interior surface of another molded article stacked thereon or thereunder. The abrasive rubbing can result in unacceptable levels of damage to the finished exterior surface, such as paint picking, paint burnishing, coating removal, and cracking. Damage to the exterior surface can ruin the finish, devaluing the article or making it commercially unacceptable. To reduce and possibly avoid such surface damage, protective materials such as slip sheets (made of, for example, paper, plastic, etc.) and/or spacers (made of, for example, cardboard) may be placed on each molded article in the stack.

The present inventors have observed that surface damage is particularly pronounced on the exterior surface of the articles having inner panels that are recessed from the main body portion of the article. Paint pricking, paint burnishing, coating removal, and cracking are especially problematic at the inner panel corners and the adjacent corners of the contoured portions of the recessed inner panels. The present inventors surmise that these problems are localized at these corner areas because the corner areas, as the result of the geometry of the inner panels, are rigid relative to the remainder of the skin. The present inventors believe that, unlike other areas of the molded articles, the corner areas of the recessed panels are unable to flex in response to the stack load or stacking shifting during transport and handling.

SUMMARY OF THE INVENTION

A first aspect of the invention provides a molded article including an inner panel portion having a plurality of inner panel corners, a main body portion, and a contoured portion extending between and interconnecting the inner panel portion and the main body portion so as to surround the inner panel portion and be surrounded by the main body portion. The contoured portion includes contoured corner segments adjacent to the inner panel corners of the inner panel portion and contoured intermediate segments extending lengthwise between respective pairs of the contoured corner segments. The contoured intermediate segments have an exterior surface, an interior surface, and a first maximum thickness measured from the exterior surface of the contoured intermediate segments to a closest point on the interior surface of the contoured intermediate segments. The contoured corner segments have an exterior surface, an interior surface, and a second maximum thickness measured from the exterior surface of the contoured corner segments to a closest point on the interior surface of the contoured corner segments. The first maximum thickness is greater than the second maximum thickness.

A second aspect of the invention provides a molded article including an inner panel portion having a plurality of inner panel corners, a main body portion, and a contoured portion extending between and interconnecting the inner panel portion and the main body portion so as to surround the inner panel portion and be surrounded by the main body portion. The contoured portion includes contoured corner segments adjacent to the inner panel corners of the inner panel portion and contoured intermediate segments extending lengthwise between and interconnecting respective pairs of the contoured corner segments. The contoured intermediate segments have a first maximum thickness, and the contoured corner segments have a second maximum thickness, wherein the first maximum thickness is greater than the second maximum thickness. The molded article is stackable with an identical molded article, one on another, in a stacked relationship in which the difference in thickness between the first and second maximum thicknesses displaces a load of the upper stacked molded article on the lower stacked molded article from the contoured corner segments to the contoured intermediate segments so that the contoured intermediate segments bear a majority of the load.

A third aspect of the invention provides a molded article including an inner panel portion, a main body portion, and a contoured portion extending between and interconnecting the inner panel portion and the main body portion so as to surround the inner panel portion and be surrounded by the main body portion. The contoured portion includes contoured corner segments and contoured intermediate segments extending in a lengthwise direction between and interconnecting respective pairs of the contoured corner segments. The contoured intermediate segments have a first maximum thickness. The contoured corner segments have a second maximum thickness. The first maximum thickness is greater than the second maximum thickness. The first maximum thickness is uniform along the entire lengths of the contoured intermediate segments, and the second maximum thickness is uniform along the entire lengths of the contoured corner segments.

Another aspect of the invention provides stacked molded articles.

A further aspect of the invention provides door including a frame and at least one molded article secured to one side of the frame, and optionally an additional molded article secured to the opposite side of the frame.

Still further, the invention provides methods and molding apparatus for making the molded articles.

Other aspects and embodiments of the invention, including articles, stacked articles, devices, assemblies, molding apparatus, kits, methods and processes of making and using, and the like which constitute part of the invention, will become more apparent upon reading the following detailed description of the exemplary embodiments.

BRIEF DESCRIPTION OF THE DRAWINGS

The accompanying drawings are incorporated in and constitute a part of the specification. The drawings, together with the general description given above and the detailed description of the exemplary embodiments and methods given below, serve to explain principles of the invention. In such drawings.

Figure 1:
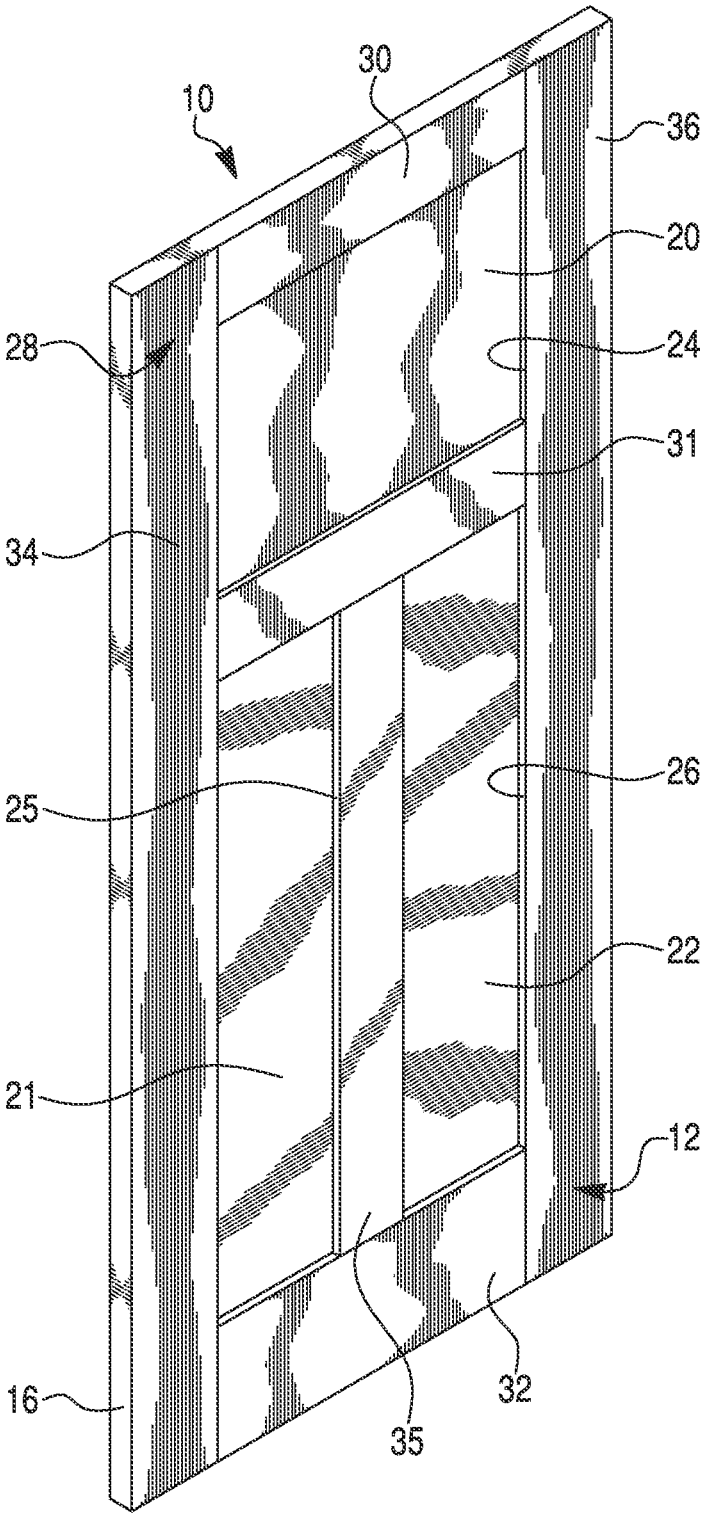
FIG. 1 is a front perspective view of a door assembly according to an exemplary embodiment of the invention.

DETAILED DESCRIPTION OF PREFERRED EMBODIMENTS AND PREFERRED METHODS OF THE INVENTION

Reference will now be made in detail to the exemplary embodiments and methods as illustrated in the accompanying drawings, in which like reference characters designate like or corresponding parts throughout the drawings. It should be noted, however, that the invention in its broader aspects is not necessarily limited to the specific details, representative materials and methods, and illustrative examples shown and described in connection with the exemplary embodiments and methods.

Figure 2:
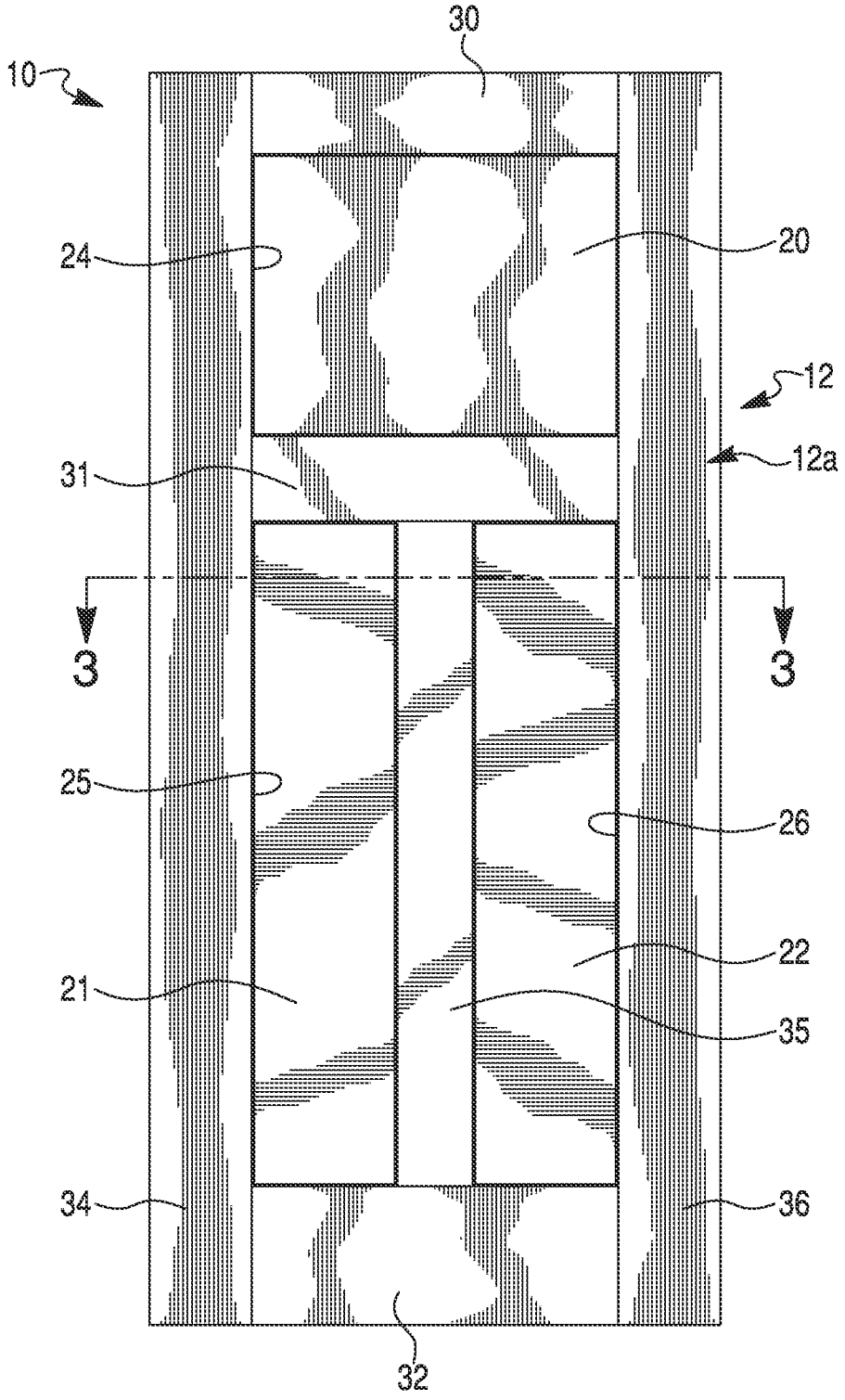
FIG. 2 is an elevational view of the door assembly of FIG. 1.
Figure 3:
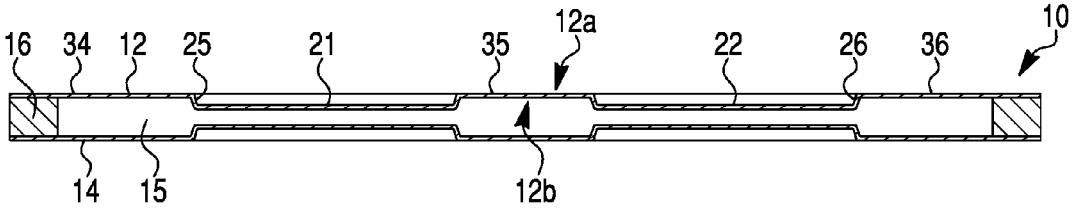
FIG. 3 is a cross-sectional view taken along section line 3-3 of FIG. 2.

Referring initially to FIGS. 1-3, there is illustrated an embodiment of a recessed panel door, generally designated by reference numeral 10, including a first door skin 12, and an identical second door skin 14. The skins 12, 14 are secured, e.g., adhesively and/or with fasteners, to opposite major surfaces of a support structure 16, such as a door frame. In the cross-sectional view of FIG. 3, the stiles of a door frame are illustrated as part of the support structure 16. Rails having like cross sections to those of the stiles may extend along the top and bottom edges of the door 10. Intermediate rails and/or stiles may also be included as part of the support structure. The support structure 16 may establish the top, bottom, and side edges of the recessed panel door 10.

The exemplary door skins 12, 14 shown in FIGS. 1-3 are molded to simulate a multi-panel door surface. The door skin 12 of the illustrated embodiment of FIGS. 1-3 has an exterior surface 12*a* containing three inner panel portions (or simply inner panels) 20, 21, and 22. The inner panel portions 20, 21, and 22 are shown lying in a common plane with one another. In the illustrated embodiment, each of the inner panel portions 20, 21, and 22 possesses a rectangular perimeter. It should be understood that the perimeters of the inner panel portions 20, 21, and 22 may establish other shapes, such as squares and other polygons, circles, ellipses, etc. The inner panel portions 20, 21, 22 may have perimeters formed by a combination of one or more linear edges and one or more curvilinear edges. The edges of the inner panel portions 20, 21, and 22 may be linear from end to end, curvilinear from end to end, or a combination of linear and curvilinear segments. It should be understood that door skins 12, 14 may contain fewer or more inner panels than shown, including only a single inner panel. The inner panel portions 20, 21, and 22 may have the same or different shapes and/or dimensions from one another. Similarly, the door skins 12, 14 may have an identical or different arrangement of inner panels and other surface features on their respective exterior surfaces. Although not shown, a core component or core components may be placed in the door 10 in a core cavity 15 (FIG. 3) between the door skins 12, 14. The core component (s) may be, for example, polyurethane foam.

Surrounding each of the inner panel portions 20, 21, and 22 is a respective contoured portion 24, 25, and 26, each of which has a rectangular appearance in the elevational view depicted in FIG. 2. The shapes of the contoured portions 24, 25, and 26 match the inner panel portions 20, 21, and 22 they surround. Each of the contoured portions 24, 25, and 26 is in turn surrounded by a main body portion 28. The main body portion 28 in turn extends continuously to the perimeter edges of the door skin 12 and is secured to the support structure and, if present, the core (not shown). The term "main" as used in connection with the term "main body portion" does not necessary mean a majority of the surface area of the exterior surface 12*a*. For example, the inner panel portions 20-22 can collectively make up the majority of the surface area of the exterior surface 12*a* of the door skin 12.

The main body portion 28 of the first door skin 12 embodied in FIGS. 1-3 includes strike lines that delineate a top horizontal plank (or board) area 30, a middle horizontal plank (or board) area 31, a bottom horizontal plank (or board) area 32, side vertical plank (or board) areas 34 and 36 on opposite sides of the exterior surface 12*a*, and a middle vertical plank (or board) area 35. The horizontal plank areas 30, 31, and 32 are sometimes referred to as rail areas, and the vertical plank areas 34, 35, and 36 are sometimes referred to as stile areas. These rail and stile areas 30-32 and 34-36 each extend in a common plane to one another. The plane in which the inner panel portions 20, 21, and 22 lie is parallel but recessed relative to the plane in which the main body portion 28 lies. In FIG. 3, the features of the second door skin 14 are not numbered, but as shown are the mirror images of those of the first door skin 12. It should be understood that the first and second door skins 12 and 14 are not necessarily mirror images of one another. The first and second door skins 12 and 14 may have different appearances. Either of the door skins 12 or 14 may have a flush surface.

The inner panel portions 20, 21, and 22, the contoured portions 24, 25, and 26, and the main body portion 28 are shown integral with one another as a unitary or monolithic structure. For example, the portions 20-22, 24-26, and 28 may be molded from a single mat or reformed from a single blank to form the integral structure. Alternatively, these portions 20-22, 24-26, and 28 may be made of separate components and secured to one another. The exterior surface 12*a* may be molded or otherwise provided with a surface pattern, such as a wood grain pattern and/or tonal areas. Typically, the exterior surface 12*a* has one or more coatings, which may include, for example, paint, stain, lacquer, and/or a protective finish.

Figure 4A:
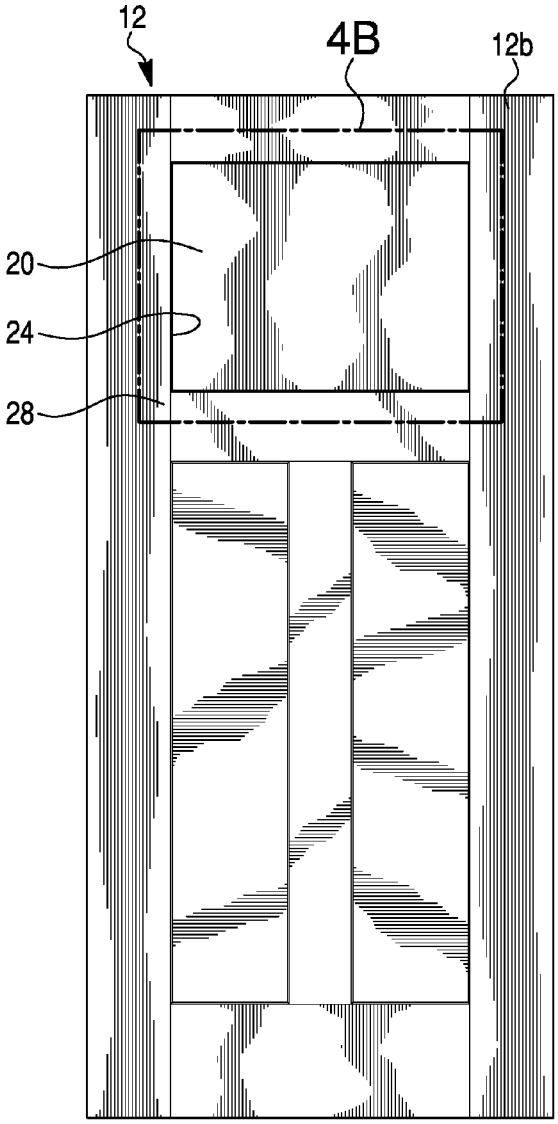
FIG. 4A is a rear view of a door skin of the door assembly of FIG. 1, showing the interior surface of the door skin.

FIG. 4A shows a rear view of the door skin 12, and in particular the interior surface 12*b* of the door skin 12. The inner panel portions 20-22 and the contoured portions 24-26 are all visible at the interior surface 12. The inner panel portions 20-22, which are recessed from the viewpoint of the exterior surface 12*a*, instead protrude from the viewpoint of the interior surface 12*b*. Because the interior surface 12*b* faces the core cavity 15 and is concealed from view in the finished door 10, often the interior surface is not coated and does not include a wood grain pattern.

For discussion purposes, the inner panel portion 20 and the contoured portion 24 are primarily discussed below, mostly in connection with FIG. 4B. As discussed above in connection with FIGS. 1-3, the contoured portion 24 extends between and integrally interconnects the inner panel portion 20 and the main body portion 28 so as to surround the inner panel portion 20 and be surrounded by the main body portion 28. As best shown in FIG. 5, discussed below, the contoured portion 24 is generally configured as a slanted wall, angled inward from the main body portion 28 towards the inner panel portion 20, with rounded ends. It should be understood that the following discussion also applies to the other inner panel portions 21 and 22 and other contoured portions 25 and 26 of the illustrated embodiment.

Figure 4B:
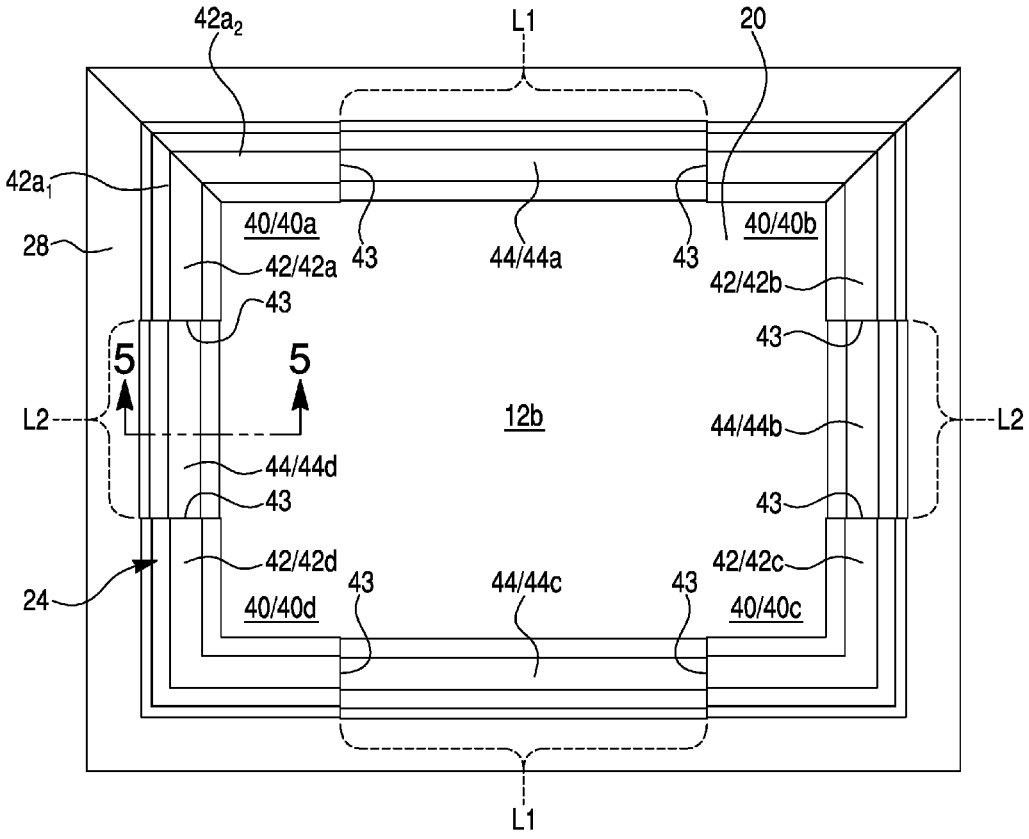
FIG. 4B is an enlarged, fragmentary view of a portion 4A of the interior surface of the door skin of FIG. 4A.
Figure 5:
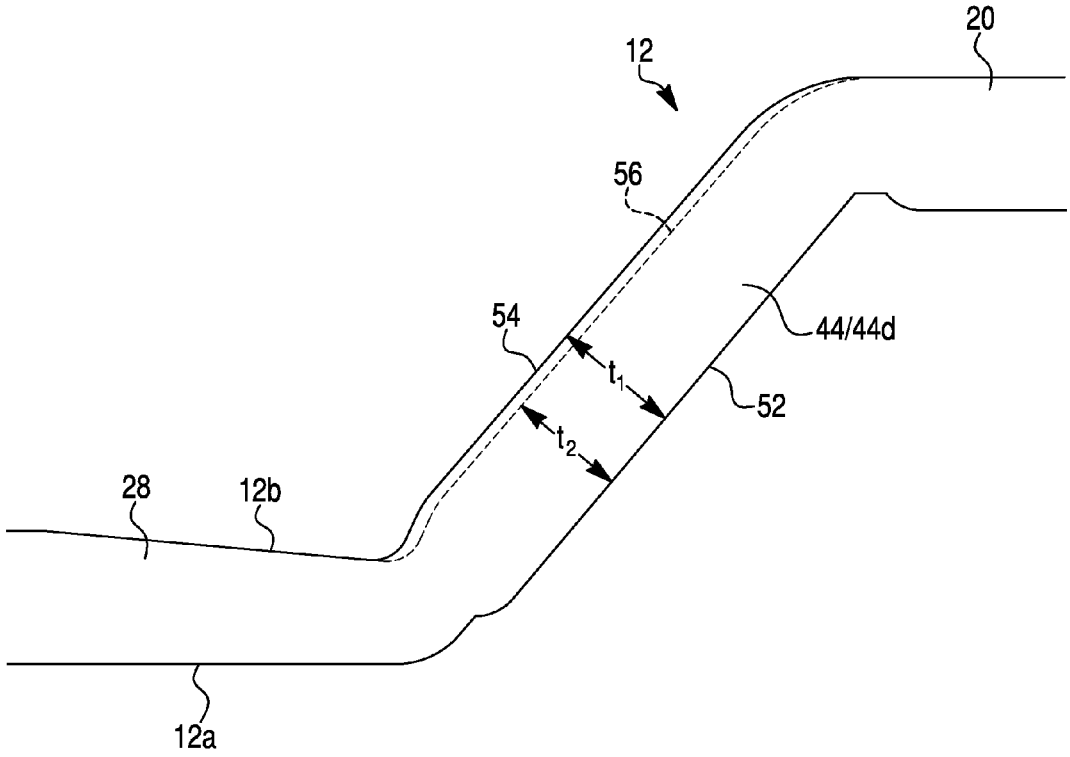
FIG. 5 is an enlarged, fragmentary cross-sectional view taken along sectional line 5-5 of FIG. 4B.

As best shown in FIG. 4B, the interior surface 12*b* of the inner panel portion 20 establishing a plurality (four as shown) of inner panel corners 40*a*, 40*b*, 40*c*, and 40*d*, which are collectively referred to herein by numeral 40. The contoured portion 24 includes a plurality of contoured corner segments 42*a*, 42*b*, 42*c*, and 42*d* (collectively referred to herein by numeral 42) and a plurality of contoured elongated segments 44*a*, 44*b*, 44*c*, and 44*d* (collectively referred to herein by numeral 44 and as contoured intermediate segments) extending between respective pairs of the contoured corner segments 42. The contoured elongated segments 44*a* and 44*c* have a length L1, and the contoured elongated segments 44*b* and 44*d* have a length L2. The contoured corner segments 42 interface the contoured elongated segments 44 at transition areas 43. For example, the contoured elongated segment 44*a* extends between the contoured corner segments 42*a* and 42*b*, with transition areas 43 located where the opposite ends of the contoured elongated segment 44*a* meet the contoured corner segments 42*a* and 42*b*. The contoured elongated segment 44*b* extends between and interfaces the contoured corner segments 42*b* and 42*c* at transition areas 43. The contoured elongated segment 44*c* extends between the contoured corner segments 42*c* and 42*d* and interfaces the corners segments 42*c*, 42*d* at transition areas 43. The contoured elongated segment 44*d* extends between the contoured corner segments 42*d* and 42*a* and interfaces the contoured corner segments 42*d*, 42*a* at transition areas 43. The contoured corner segments 42*a*, 42*b*, 42*c*, and 42*d* are adjacent to the inner panel corners 40*a*, 40*b*, 40*c*, and 40*d*, respectively. The contoured corner segments 42 and the contoured elongated segments 44 are arranged end to end to collectively establish the contoured portion 24 as a continuous rectangle.

The contoured corner segments 42 each include two legs. For example, FIG. 4B shows the contoured corner segment 42*a* including legs $42a_1$ and $42a_2$. In the case of the illustrated embodiment with rectangular inner panels, the legs $42a_1$ and $42a_2$ are perpendicular to one another. The legs $42a_1$, $42a_2$, etc., are preferably at least 0.25 inch, and optionally at least 1.0 inch, in length to avoid problems such as paint picking, paint burnishing, coating removal, and cracking at the contoured corner segments 42. For example, the legs 42$a_1$, 42$a$2 may be in a range of about 0.25 inch to about 3 inches, or about 0.25 inch to about 1 inch in length. Generally, the greater the overall size of the door skin 12 and the inner panels 20-22, the longer the legs 42$a_1$, 42$a_2$, etc. The contoured corner segments 42 and the contoured elongated segments 44 of FIG. 4B are not to scale. The contoured elongated segments 44 are typically but not necessarily much longer than the legs of the contoured corner segments 42.

Referring now to FIG. 5, a fragmented sectional view of the contoured elongated segment 44*d* taken along sectional line 5-5 of FIG. 4B is shown. For the purposes of FIGS. 5 and 6, exterior surface 52 corresponds to the exterior surface 12*a* of the door skin 12 along the contoured portion 24. The contoured elongated segment 44*d* includes an interior surface 54 (corresponding to the interior surface 12*b* of the door skin 12) facing upward in FIG. 5. As discussed further below, reference numeral 56 represents the interior surface of the contoured corner segments 42, including contoured corner segment 42*a*.

Each of the contoured elongated segments 44, including the contoured elongated segment 44*d*, has a first maximum thickness $t_1$. Thickness measurements for determining $t_1$ taken from any point along the exterior surface 52 of the contoured elongated segments are to the closest point on the interior surface 54 of the contoured elongated segments. These thickness measurements are usually perpendicular to the exterior surface 52. The first maximum thickness $t_1$ is uniform along the entire length of the contoured elongated segments 44.

In FIG. 5, the broken (or dashed) line 56 represents the interior surface of the contoured corner segment 42*a*, which is hidden from view behind the contoured elongated segment 44*d* from the viewpoint of sectional line 5-5. The interior surface 56 is generally parallel to but not coplanar with the interior surface 54 of the contoured elongated segment 44*d*. Each of the contoured corner segments 42, including the contoured corner segment 42*a*, has a second maximum thickness $t_2$ that is less than the first maximum thickness $t_1$ of the contoured elongated segments 44. That is, the contoured corner segments 42 have a smaller maximum thickness $t_2$ than the thickness $t_1$ of the contoured elongated segments 44. The second maximum thickness $t_2$ is determined in the same manner as the first maximum thickness $t_1$, except that distance is measured between exterior surface 52 and the interior surface 56 of the contoured corner segment 42*a*. The second maximum thickness $t_2$ is uniform along the entire length of the contoured corner segments 42.

Providing the contoured elongated segments 44 with a greater thickness than the contoured corner segments 42 improves weight distribution when the door skins 12 are stacked on one another. The thickness differential displaces load from the thinner contoured corner segments 42 to the contoured elongated segments 44, where paint burnishing, cracking, and other problems are less likely to occur.

In the case of an interior or exterior door assembly, such as assembly 10, standard door skins are usually about 0.1 inch to about 0.4 inch thick. For door skins of this order of thickness, the maximum thickness difference $t_1$ minus $t_2$ may be, for example, on the order of 0.001 inch (1 mil) to 0.025 inch (25 mil), or 0.001 inch (1 mil) to 0.013 inch (13 mil), or about 0.005 inch (5 mil). As may be apparent from comparing these measurements with the drawings, the difference in maximum thicknesses $t_1$ relative to $t_2$ illustrated in FIGS. 5 and 6 has been exaggerated in FIGS. 5 and 6 for explanatory purposes, i.e., so that the thickness difference is more easily observed.

With the exception of the maximum thickness differences $t_1$ versus $t_2$ described herein, the door skins and other molded articles desirably have a substantially uniform thickness to reduce painting requirements and labor required to establish a uniform coating on the articles. Large deviations in thickness can result in a loss or reduction in uniformity, stackability, and/or intended functionality of articles.

Figure 6:
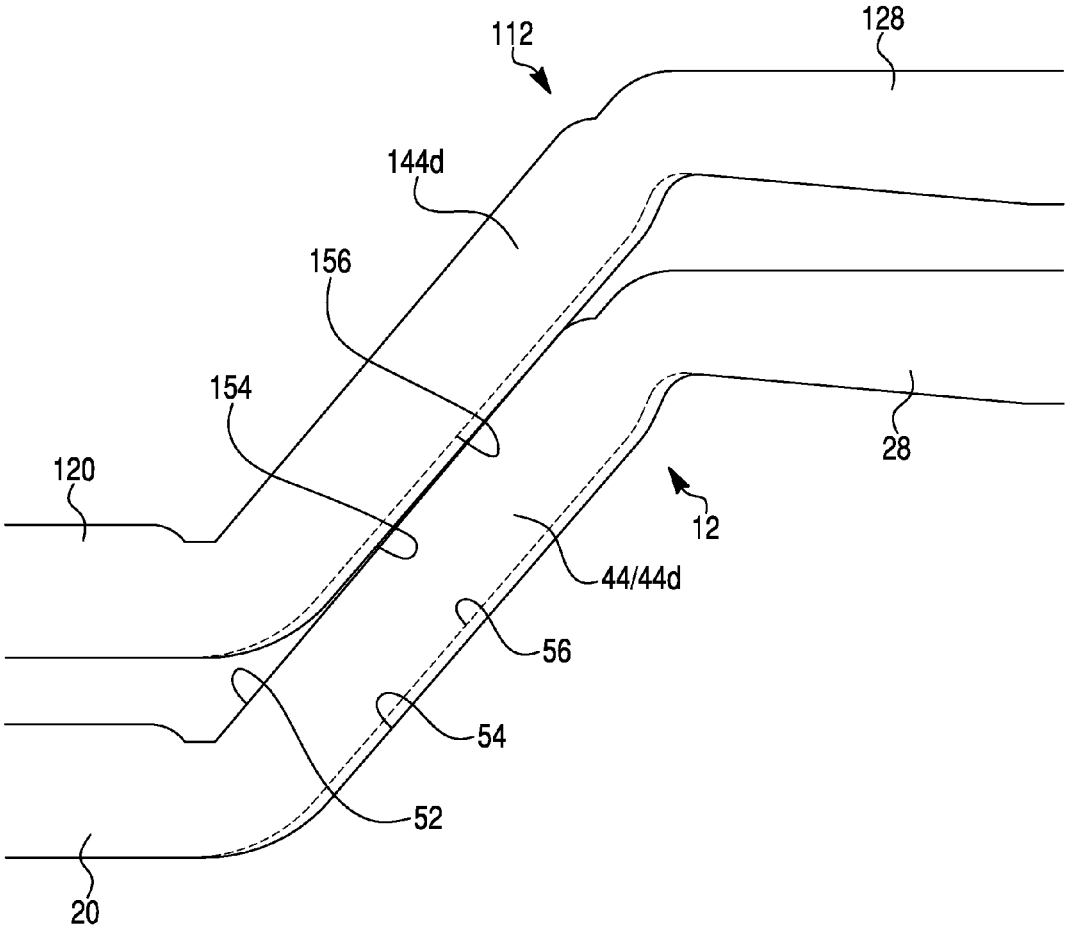
FIG. 6 is an enlarged, fragmentary cross-sectional view of two stacked door skins, the view of each door skin being taken along a sectional line situated similarly to the sectional line 5-5 of FIG. 4B, with the door skins being inverted and in stacked and nested relationship.

FIG. 6 shows two identical door skins 12 and 112 stacked one above the other in nesting relationship. Identical reference numerals are used to identify equivalent parts of the door skins 12 and 112, except that one hundred (100) is added to the reference numerals of the upper door skin 112. FIG. 6 shows the door skins 12, 112 inverted relative to the view of FIG. 5, with the inner panel portions 20, 120 to the left and the main body portions 28, 128 to the right in the drawing. In the stacked relationship, the contoured elongated segments 44*d*, 144*d* of the stacked molded articles 12, 112 abut against one another to establish contact zones. In FIG. 6, the exterior surface 52 of the lower door skin 12 faces upward and contacts the downwardly facing interior surface 154 of the contoured elongated segment 144*d* of the upper door skin 112.

Because of the lesser thicknesses of the contoured corner segments of the upper door skin 112, the upwardly facing exterior surfaces 52 of the contoured corner segments 42 of the lower door skin 12 are spaced from and typically not in contact with the downwardly facing interior surfaces 156 of the contoured corner segments of the stacked upper door skin 112 to establish corner relief areas. Even if the stacked contoured corner segments are not spaced from one another, which is more likely where the thickness differential between $t_1$ and $t_2$ is small and/or the molded articles have high flexibility, the thickness differential between $t_1$ and $t_2$ distributes the load of the stacked articles better (and places more load on the contoured elongated segments) than conventional door skins lacking the thickness differential. Consequently, loads at the inner panel corners and the contoured corner segments are reduced, reducing the likelihood of damage to the paint and/or finish.

As best shown in FIGS. 5 and 6, the difference in maximum thickness $t_1$ versus $t_2$ of door skins 12, 112 is attributable to variations in the profile at the interior surface 12*b* of the door skin, that is, differences in the profiles of interior surfaces 54 and 56, particularly at the contoured corner segments. In the illustrated embodiments, the exterior surface 52 of the contoured portion 24 has a uniform profile along an entire length of the contoured portion 24, i.e., along the length of each of the contoured corner segments 42 and each of the contoured elongated segments 44. Profile variations responsible for the different thicknesses $t_1$ versus $t_2$ are incorporated into the interior surface 12*b*, more specifically profile differences between the interior surfaces 54 and 56 that account for thickness differences. In this way, to the extent that the thickness variations are discernible to the unaided human eye, e.g., the consumer, the thickness variations are concealed in the core cavity 15 of the assembled door 10. That is, referring back to FIG. 3, in the assembled door 10 the profile variations along the length of the interior surface 12*b* of the contoured portions 24-26 face the core cavity 15 and are concealed from view in the core cavity 15 when the assembled door 10 is advertised and sold to the consumer.

As mentioned above, the exterior surface 12*a* typically has one or more coatings, which may be, for example, paint, stain, lacquer, or a protective finish. During stacking, transport, and handling, abrasive rubbing of between stacked door skins (and other articles discussed below) can cause damage to the finished exterior surface, such as paint picking, paint burnishing, coating removal, and cracking. Typically, with conventional molded articles with recessed panels, this damage is most prominent at the corners of the inner panel portion and the contoured portion, where most of the load created by stacking is carried. The thickness differential described herein creates corner relief areas at the contoured corner segments 42 having a second maximum thickness $t_2$ that is less than the first maximum thickness $t_1$ of contoured elongated segments 44. In exemplary embodiments, the lesser second maximum thickness $t_2$ at the contoured corner segments 42 spaces the surfaces 52 and 156 (FIG. 6) from one another. In other embodiments, the surfaces 52 and 156 of stacked articles contact one another, but the thickness differential is sufficient to shift part of the load of the stacked articles away from to contoured corner segments 42 and distribute the load to other parts of the door skins 12, 112, such as the contoured elongated segments 44, 144.

The contoured corner segments 42, which are most prone to damage in the case of stacked/nested conventional recessed panel articles, are subject to less stress and are less likely to be damaged by abrasive rubbing between stacked/nested articles. Additionally, the above-described benefits associated with exemplary embodiments may reduce or altogether avoid damage to stacked molded articles, even during transport, without requiring protective materials such as slip sheets and/or spacers to be interposed between the articles.

Although the illustrated contoured portions 24-26 of the embodiment illustrated in FIGS. 1-6 are configured as slanted walls, it should be understood that the profiles of the contoured portions 24-26 may possess other configurations, including those having stepped, concave and/or convex areas. As another modification, instead of recessed inner panels, the exterior surface of the molded article may include protruding inner panels. Alternatively, the inner panels can be coplanar with the main body portion, although the corner load problem described above is not as prevalent in articles having a main body portion that is coplanar with the inner panels. Combinations of these and other embodiments, including modified and alternative embodiments, may be implemented.

For example, FIGS. 7A, 7B, 8, and 9 illustrate a door skin 212 (and an additional door skin 312 in FIG. 9) having an inner panel 220 (and an additional inner panel 320 in FIG. 9) that is coplanar with a main body portion 228 (and an additional main body portion 328 in FIG. 9), and a concave contoured portion 224 (and 324). Identical reference numerals are used to identify equivalent parts of the door skins 12 relative to 212 (and door skins 112 relative to 312), except that two hundred (200) is added to the reference numerals.

Figure 7A:
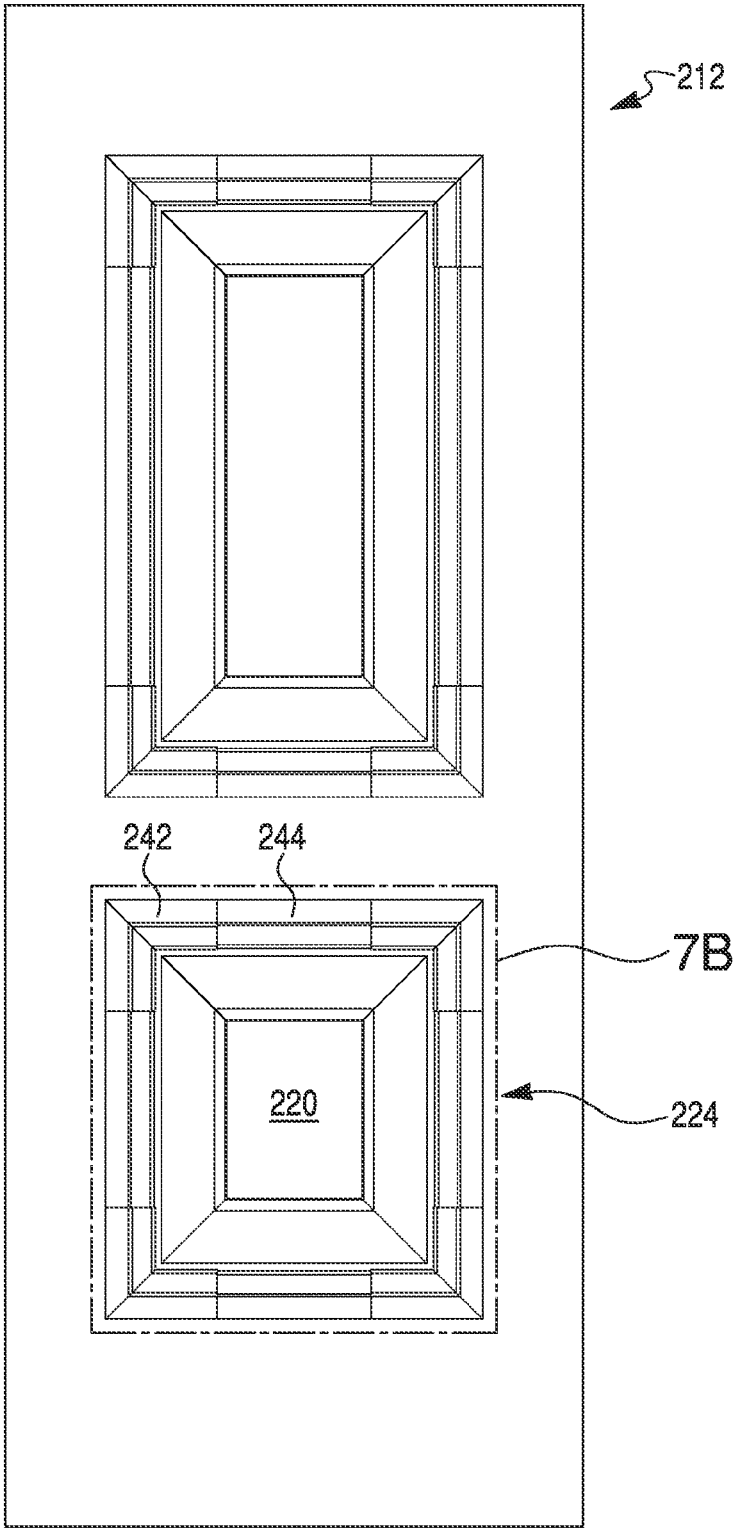
FIG. 7A is a rear view of a door skin according to another exemplary embodiment, showing the interior surface of the door skin.
Figure 7B:
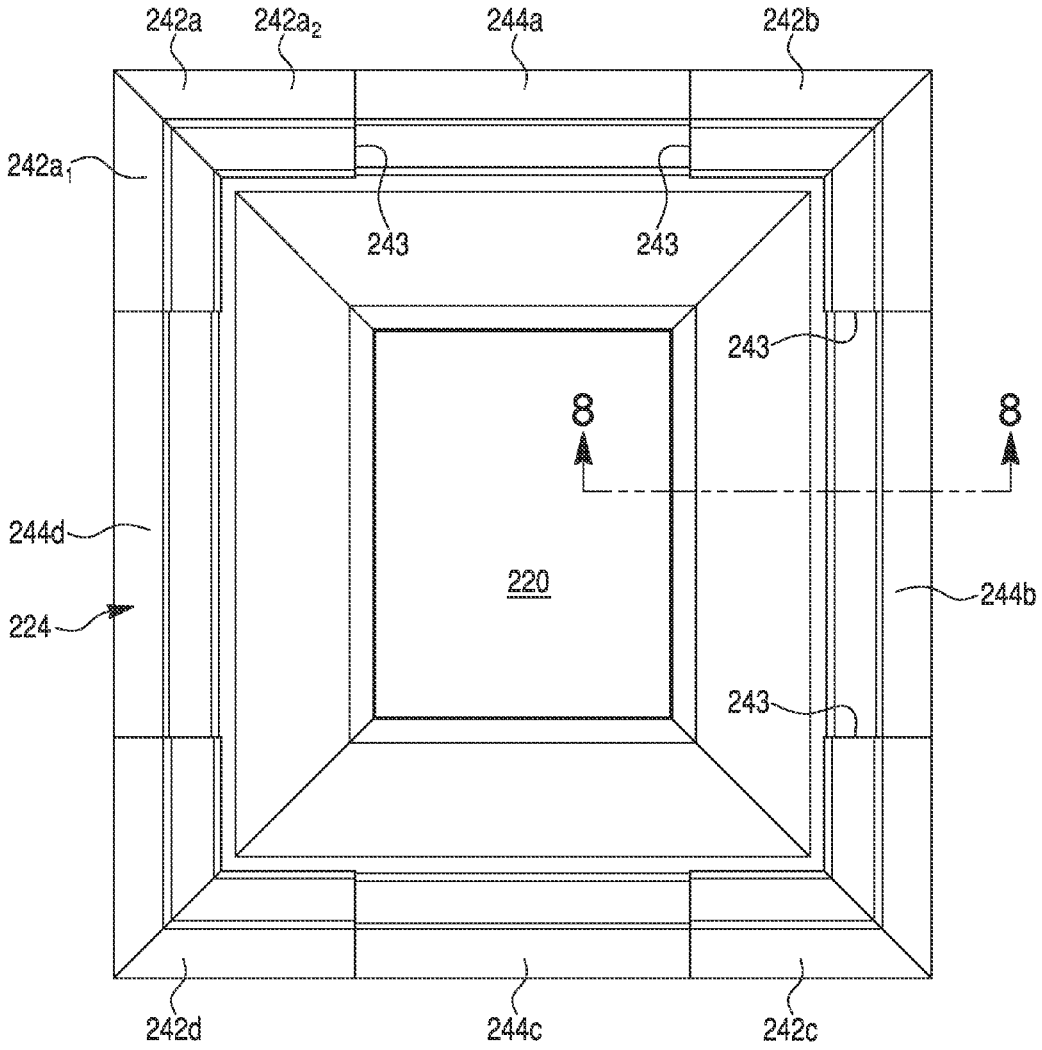
FIG. 7B is an enlarged, fragmentary view of a portion 7B of the interior surface of the door skin of FIG. 7A.

The door skin 212 is a two-panel door, as best shown in FIG. 7A. FIG. 7B illustrates an enlarged view of area 7B of the door skin 212. The inner panel portion 220 is surrounded by the contoured portion 224, which is in turn surrounded by the main body portion 228, which extends continuously to the perimeter edges of the door skin 212.

Figure 9:
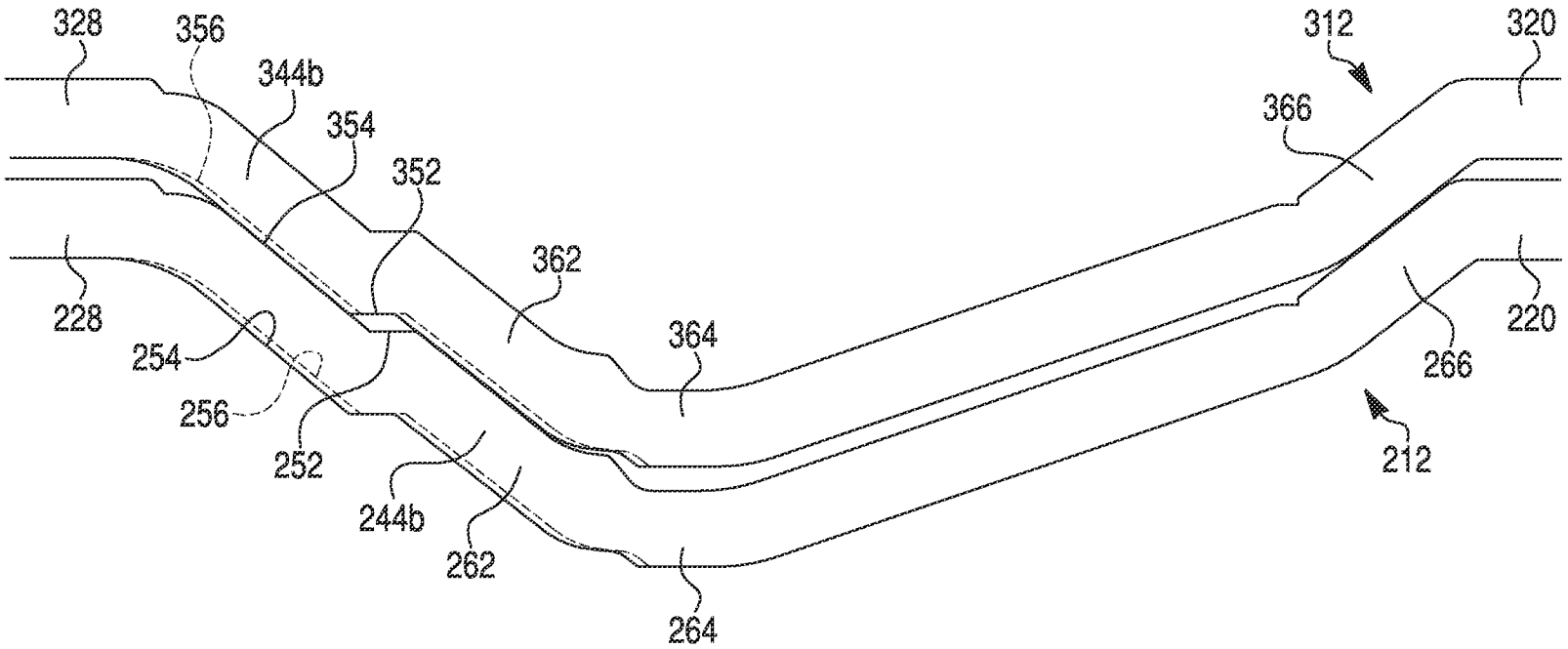
FIG. 9 is an enlarged, fragmentary cross-sectional view of two stacked door skins, the view of each door skin being taken along a sectional line situated similarly to the sectional line 8-8 of FIG. 7B, with the door skins being inverted and in stacked and nested relationship.

As best shown in FIG. 7B, the contoured portion 224 includes an outer angular region 262 obliquely angled relative to and extending from the main body portion 228, an inner angular region 266 obliquely angled relative to and extending from the inner panel portion 220, and a vertex region 264 interconnecting the outer angular region 262 and the inner angular region 266. Regions 262, 264, and 266 are integral with one another as a unitary piece. Similarly, FIG. 9 shows a door skin 312 with an outer angular region 362 obliquely angled relative to and extending from the main body portion 328, an inner angular region 366 obliquely angled relative to and extending from the inner panel portion 320, and a vertex region 364 interconnecting the outer angular region 362 and the inner angular region 366. Regions 362, 364, and 366 are integral with one another as a unitary piece.

The outer angular region 262 of the contoured portion 224 includes a plurality of contoured corner segments 242*a*, 242*b*, 242*c*, and 242*d* (collectively referred to herein by numeral 242) and a plurality of contoured elongated segments 244*a*, 244*b*, 244*c*, and 244*d* (collectively referred to herein by numeral 244 and also as contoured intermediate segments) extending between respective pairs of the contoured corner segments 242. The contoured corner segments 242 interface the contoured elongated segments 244 at transition areas 243. The contoured corner segments 242 and the contoured elongated segments 244 are arranged end to end to collectively establish a continuous rectangle.

The contoured corner segments 242 each include two legs. For example, the contoured corner segment 242*a* includes legs 242$a_1$ and 242$a_2$, which are perpendicular to one another. The legs 242$a_1$, 242$a_2$, etc., are preferably at least 0.25 inch, and optionally at least 1.0 inch, in length. Generally, the greater the overall size of the door skin 212 and the inner panel 220, the longer the legs 242$a_1$, 242$a_2$, etc. The lengths of the contoured corner segments 242 to the contoured elongated segments 244 in FIG. 7B are not to scale. The contoured elongated segments 244 are typically but not necessarily much longer than the legs of the contoured corner segments 242, as better shown in FIG. 7A.

Figure 8:
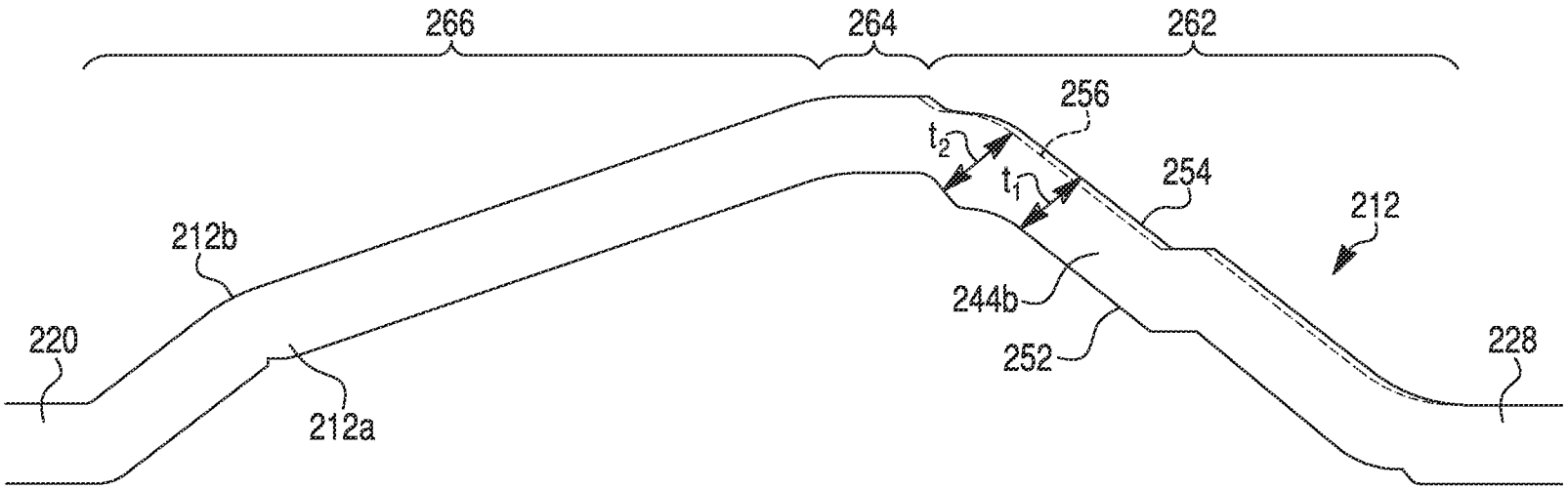
FIG. 8 is an enlarged, fragmentary cross-sectional view taken along sectional line 8-8 of FIG. 7B.

FIG. 8 illustrates a fragmented sectional view of the contoured portion 224, specifically taken along the contoured elongated segment 244*b* at sectional line 8-8 of FIG. 7B. The contoured portion 224 includes an interior surface 254 (corresponding to the interior surface 212*b* of the door skin 212) facing upward in FIG. 8, and an opposition exterior surface 252 (corresponding to the exterior surface 212*a*) facing downward in FIG. 8.

The contoured elongated segments 244 have a first maximum thickness $t_1$ measured from the exterior surface 252 to the closest point on the interior surface 254. The contoured corner segments 242 have a second maximum thickness $t_2$ measured from the exterior surface 252 to the closest point on an interior surface 256 of the contoured corner segments 242. These thickness measurements are usually perpendicular to the exterior surface 252.

In FIGS. 8 and 9, the broken (or dashed) line 256 represents the interior surface of the contoured corner segment 242*b*, which is hidden from view behind the contoured elongated segment 244*b* from the viewpoint of sectional line 8-8. The second maximum thicknesses $t_2$ of the contoured corner segments 242 is less than the first maximum thickness $t_1$ of the contoured elongated segments 244. Providing the contoured elongated segments 244 with a greater thickness than the contoured corner segments 242 improves weight distribution when the door skins 212 are stacked on one another. The thickness differential displaces load from the thinner contoured corner segments 242 to the contoured elongated segments 244, where paint burnishing, cracking, and other problems are less likely to occur.

FIG. 9 shows the door skin 212 and an identical door skin 312 stacked on the door skin 212 in nesting relationship. FIG. 9 shows the door skins 212, 312 inverted relative to the view of FIG. 8, with the inner panel portions 220, 320 to the right and the main body portions 228, 328 to the left in the drawing. In the stacked relationship, the contoured elongated segments 244*b*, 344*b* of the stacked molded articles 212, 312 abut against one another to establish contact zones. In FIG. 9, the exterior surface 252 of the lower door skin 212 faces upward and contacts the downwardly facing interior surface 354 of the contoured elongated segment 344*b* of the upper door skin 312.

Because of the lesser thicknesses of the contoured corner segments 242 of the upper door skin 312, the upwardly facing exterior surfaces 252 of the contoured corner segments 242 of the lower door skin 212 are spaced from and typically not in contact with the downwardly facing interior surfaces 356 of the contoured corner segments of the stacked upper door skin 312 to establish corner relief areas over the outer angular regions 262. Even if the outer angular areas 262 of the stacked contoured corner segments 252 are not spaced from one another, which is more likely where the thickness differential between $t_1$ and $t_2$ is small and/or the molded articles 212, 312 have high flexibility, the thickness differential between $t_1$ and $t_2$ distributes the load of the stacked articles better (and places more load on the contoured elongated segments) than conventional door skins lacking the thickness differential. Consequently, loads at the corners of the inner panels 320 and the contoured corner segments are reduced, reducing the likelihood of damage to the paint and/or finish.

The thickness difference ($t_1$–$t_2$) discussed herein in connection with FIGS. 7A, 7B, 8, and 9 is illustrated only at the outer angular region 262 of the contoured portion 224. The vertex region 264 and the inner angular region 266 do not have corner and elongated segments of different thicknesses $t_1$-$t_2$. The reason for providing the thickness differential at the outer angular region 262 is that problems such as paint picking, paint burnishing, coating removal, and cracking typically are much more likely to occur at the outer angular region 262 than at the vertex or inner angular regions 264, 266. However, it should be understood that the thickness differences ($t_1$–$t_2$) may be applied to the vertex region 264 and/or the inner angular region 266 as well.

In the illustrated embodiments, the man-made molded articles are in the form of a multi-panel door, or, more particularly, a thin door skin to be laminated or otherwise adhered to a core, frame or other support substrate, on both major surfaces of the support substrate, to simulate a solid door, optionally with an appearance simulating a natural wood door. Although illustrated as an interior or exterior passage (or entry) door, it should be understood that the principles described herein may be applied to other door applications, for example, as cabinet, closet, and furniture doors. Optionally, the door may include only one door skin. It should be understood that the principles of the present invention apply to much more than doors or door skins. Examples of other man-made molded articles that are capable of being manufactured in accordance with the principles of the present invention include decorative hardboard, interior and exterior siding, decorative interior wall paneling, wainscot, other building and construction material, and the like.

The molded articles may be formed of a composite containing an organic cellulosic material, such as cellulosic fibers or cellulosic particles, and a binder capable of adhesively binding the cellulosic material together into a structurally stable article. The organic fibrous material is typically relatively small fibers or particles of wood, e.g., pine, oak, cherry, maple and combinations of the same or other woods. Other cellulosic materials such as straw, rice husks and knaff may be used in combination with or as an alternative for wood fibers and/or particles. The cellulosic material may be present as dust, fibers, discrete particles, or other forms. The cellulosic material, whether in the form of refined, fibrillated fibers, or in the form of discrete particles or sawdust, can be molded and adhered together with natural or synthetic binders to provide aesthetically pleasing contours and texture in exterior, visible surfaces. The binder may be selected from, for example, phenol-formaldehyde resin, urea-formaldehyde resin, and mixtures thereof:

High density fiberboard is particularly useful in various embodiments of the invention, although other materials such as medium density fiberboard may be selected. High density fiberboard generally contains a cellulosic fiber content of about 80 to about 97 percent by weight, based on dry weight. The binder typically constitutes about 2 to about 15 percent by weight of the dry weight of the article. Additional ingredients may also be included, such as sizing agents. Other materials that may be selected for the molded articles include, by way of example, sheet molding compounds (SMCs), bulk molding compounds (BMCs), thermoplastics, thermosets, and others.

Door skins 12 (or 112, 212, 312) and other molded articles are formed in accordance with molding procedures and using molding apparatus well known in the art, although modifications of the molding apparatus may be needed. Although not necessarily by limitation, the procedures usually employ a mold apparatus including upper and lower mold dies. One or both of the mold dies are movable towards and away from the other mold die. In the closed state, opposing surface of the mold dies define a mold cavity. The cavity-defining surface of the one of the mold dies (e.g., upper mold die) is shaped generally complementary or as the inverse of the desired shape of exterior surface 12*a* of door skin 12 or other article. The cavity-defining surface of the other mold die (e.g., lower mold die) has a shape that is generally complementary or the inverse of the desired shape of the interior surface 12*b* of door skin 12. Thus, the cavity-defining surface of this mold die responsible for molding at least one of the surfaces 12*a*, 12*b*, typically the interior surface 12*b* for reasons explained above, will have areas corresponding to the contoured corner portions and other areas corresponding to the contoured elongated portions. The difference in height between these areas of the mold die surface should correspond to the desired thickness difference $t_1$ minus $t_2$. The manufacture of mold dies having various surface features is known in the art, and may be adopted to incorporate the principles of the invention.

Different molding techniques may be practiced in accordance with various embodiments of the invention, including compression molding, injection molding, and re-forming of molded blanks. Examples of molding apparatus and procedures are described in U.S. Pat. Nos. 7,096,916, 6,743,318, and 6,579,483.

The above embodiments may be practiced in any combination with one another.

The foregoing detailed description of the certain exemplary embodiments has been provided for the purpose of explaining the principles of the invention and its practical application, thereby enabling others skilled in the art to understand the invention for various embodiments and with various modifications as are suited to the particular use contemplated. This description is not necessarily intended to be exhaustive or to limit the invention to the precise embodiments disclosed. The specification describes specific examples to accomplish a more general goal that may be accomplished in another way.

What is claimed is:

1. A molded article, comprising:

an inner panel portion having a plurality of inner panel corners;

a main body portion; and a contoured portion extending between and interconnecting the inner panel portion and the main body portion so as to surround the inner panel portion and be surrounded by the main body portion, the contoured portion comprising contoured corner segments adjacent to the inner panel corners of the inner panel portion and contoured intermediate segments extending lengthwise between respective pairs of the contoured corner segments, the contoured intermediate segments having an exterior surface, an interior surface, and a first maximum thickness measured from the exterior surface of the contoured intermediate segments to a closest point on the interior surface of the contoured intermediate segments, the contoured corner segments having an exterior surface, an interior surface, and a second maximum thickness measured from the exterior surface of the contoured corner segments to a closest point on the interior surface of the contoured corner segments, wherein the first maximum thickness is greater than the second maximum thickness.

2. The molded article of claim 1, wherein the molded article is a door skin.

3. The molded article of claim 1, wherein the molded article is stackable with an identical molded article, one on another, in a stacked relationship in which the contoured intermediate segments of the stacked molded articles abut against one another to establish contact zones, and wherein the contoured corner segments of the stacked molded articles are spaced from one another to establish corner relief areas.

4. The molded article of claim 1, wherein the molded article is stackable with an identical molded article, one on another, in a stacked relationship in which the difference in thickness between the first and second maximum thicknesses displaces a load of the upper stacked molded article on the lower stacked molded article from the contoured corner segments to the contoured intermediate segments so that the contoured intermediate segments bear a majority of the load.

5. The molded article of claim 1, wherein the first maximum thickness is uniform along the entire lengths of the contoured intermediate segments, and wherein the second maximum thickness is uniform along the entire lengths of the contoured corner segments.

6. The molded article of claim 1, wherein the contoured corner segments comprise two legs that are perpendicular to one another, and wherein the contoured intermediate segments extend linearly lengthwise between the respective pairs of the contoured corner segments.

7. A door comprising:

a frame having first and second sides; and a door skin secured to the first side of the frame, the door skin comprising the molded article of claim 1.

8. A molded article, comprising:

an inner panel portion having a plurality of inner panel corners;

a main body portion; and a contoured portion extending between and interconnecting the inner panel portion and the main body portion so as to surround the inner panel portion and be surrounded by the main body portion, the contoured portion comprising contoured corner segments adjacent to the inner panel corners of the inner panel portion and contoured intermediate segments extending lengthwise between and interconnecting respective pairs of the contoured corner segments, the contoured intermediate segments having a first maximum thickness, the contoured corner segments having a second maximum thickness, wherein the first maximum thickness is greater than the second maximum thickness, and wherein the molded article is stackable with an identical molded article, one on another, in a stacked relationship in which the difference in thickness between the first and second maximum thicknesses displaces a load of the upper stacked molded article on the lower stacked molded article from the contoured corner segments to the contoured intermediate segments so that the contoured intermediate segments bear a majority of the load.

9. The molded article of claim 8, wherein the molded article is a door skin.

10. The molded article of claim 8, wherein the molded article is stackable with the identical molded article, one on another, in a stacked relationship in which the contoured intermediate segments of the stacked molded articles abut against one another to establish contact zones, and wherein the contoured corner segments of the stacked molded articles are spaced from one another to establish corner relief areas.

11. The molded article of claim 8, wherein the first maximum thickness is uniform along the entire lengths of the contoured intermediate segments, and wherein the second maximum thickness is uniform along the entire lengths of the contoured corner segments.

12. The molded article of claim 8, wherein the contoured corner segments comprise two legs that are perpendicular to one another, and wherein the contoured intermediate segments extend linearly lengthwise between the respective pairs of the contoured corner segments.

13. A door comprising:

a frame having first and second sides; and a door skin secured to the first side of the frame, the door skin comprising the molded article of claim 8.

14. A molded article, comprising:

an inner panel portion having a plurality of inner panel corners;

a main body portion; and a contoured portion extending between and interconnecting the inner panel portion and the main body portion so as to surround the inner panel portion and be surrounded by the main body portion, the contoured portion comprising contoured corner segments adjacent to the inner panel corners of the inner panel portion and contoured intermediate segments extending in a lengthwise direction between and interconnecting respective pairs of the contoured corner segments, the contoured intermediate segments having a first maximum thickness, the contoured corner segments having a second maximum thickness, wherein the first maximum thickness is greater than the second maximum thickness, and wherein the first maximum thickness is uniform along the entire lengths of the contoured intermediate segments, and the second maximum thickness is uniform along the entire lengths of the contoured corner segments.

15. The molded article of claim 14, wherein:

the contoured intermediate segments have an exterior surface, an interior surface, and the first maximum thickness measured from the exterior surface of the contoured intermediate segments to a closest point on the interior surface of the contoured intermediate segments; and the contoured corner segments have an exterior surface, an interior surface, and the second maximum thickness measured from the exterior surface of the contoured corner segments to a closest point on the interior surface of the contoured corner segments.

16. The molded article of claim 14, wherein the molded article is a door skin.

17. The molded article of claim 14, wherein the molded article is stackable with an identical molded article, one on another, in a stacked relationship in which the contoured intermediate segments of the stacked molded articles abut against one another to establish contact zones, and wherein the contoured corner segments of the stacked molded articles are spaced from one another to establish corner relief areas.

18. The molded article of claim 14, wherein the molded article is stackable with an identical molded article, one on another, in a stacked relationship in which the difference in thickness between the first and second maximum thicknesses displaces a load of the upper stacked molded article on the lower stacked molded article from the contoured corner segments to the contoured intermediate segments so that the contoured intermediate segments bear a majority of the load.

19. The molded article of claim 14, wherein the contoured corner segments comprise two legs that are perpendicular to one another, and wherein the contoured intermediate segments extend linearly lengthwise between the respective pairs of the contoured corner segments.

20. A door comprising:

a frame having first and second sides; and a door skin secured to the first side of the frame, the door skin comprising the molded article of claim 14.

* * * * *